US008375882B1

(12) United States Patent
Stout

(10) Patent No.: US 8,375,882 B1
(45) Date of Patent: Feb. 19, 2013

(54) SYSTEM AND METHOD FOR ASCERTAINING FIELD POSITION

(76) Inventor: David W. Stout, Lewis Center, OH (US)

( * ) Notice: Subject to any disclaimer, the term of this patent is extended or adjusted under 35 U.S.C. 154(b) by 150 days.

(21) Appl. No.: 12/871,845

(22) Filed: Aug. 30, 2010

(51) Int. Cl.
*A63F 3/00* (2006.01)

(52) U.S. Cl. ..... 116/223; 116/224; 273/247

(58) Field of Classification Search ..... 116/222–225, 116/209, 313, 316, 318; D10/46.1; 273/244, 273/247; 235/70 A, 70 R
See application file for complete search history.

(56) References Cited

U.S. PATENT DOCUMENTS

| | | | | | |
|---|---|---|---|---|---|
| 1,138,678 | A | * | 5/1915 | McNair | 273/247 |
| 1,331,196 | A | * | 2/1920 | Hart | 273/247 |
| 1,584,141 | A | * | 5/1926 | Purnell | 273/247 |
| 1,596,175 | A | * | 8/1926 | Gregg | 273/247 |
| 1,617,362 | A | * | 2/1927 | Wylie et al. | 273/247 |
| 1,633,040 | A | * | 6/1927 | Schurch | 273/247 |
| 1,720,946 | A | * | 7/1929 | Doerr | 116/223 |
| 1,769,483 | A | * | 7/1930 | Allen | 116/316 |
| 2,060,973 | A | * | 11/1936 | Brown, Jr. et al. | 273/244 |
| 2,117,398 | A | * | 5/1938 | Brown, Jr. | 116/225 |
| 2,180,478 | A | * | 11/1939 | Pekalski et al. | 273/247 |
| 2,774,597 | A | * | 12/1956 | Folger | 273/247 |
| 3,043,594 | A | * | 7/1962 | Seitz | 273/247 |
| 3,526,403 | A | * | 9/1970 | Clark | 273/247 |
| 3,729,130 | A | * | 4/1973 | Bortz | 235/70 R |
| 3,837,317 | A | * | 9/1974 | Hanauer | 116/311 |
| 3,853,264 | A | * | 12/1974 | Hovorka | 235/70 A |
| 3,887,191 | A | * | 6/1975 | Lucas | 273/247 |
| 3,995,863 | A | * | 12/1976 | Cummins | 273/247 |
| 4,003,580 | A | * | 1/1977 | Haffey, Jr. | 273/247 |
| 4,660,836 | A | * | 4/1987 | Rhome | 273/247 |
| 5,158,301 | A | * | 10/1992 | Martukovich, Jr. | 273/247 |
| 5,217,229 | A | * | 6/1993 | Jaime | 273/247 |
| 5,501,456 | A | * | 3/1996 | Collins et al. | 273/259 |
| 5,769,419 | A | * | 6/1998 | Hill | 273/247 |
| 6,213,468 | B1 | * | 4/2001 | Van Dalen et al. | 273/244 |

* cited by examiner

*Primary Examiner* — Peter Macchiarolo
*Assistant Examiner* — Tania Courson
(74) *Attorney, Agent, or Firm* — Ronald J. Koch

(57) ABSTRACT

A system and method for ascertaining field position for the game of American football has first and second wheels, each being substantially planar and round. The first wheel is relatively smaller than the second wheel and the two are rotatably mounted coaxially with respect to each other to allow rotation. The wheels are marked with various notches, numbers, and arrows to allow quick and easy calculation of yards gained or lost on a given play in accordance with the described operation.

1 Claim, 3 Drawing Sheets

SYSTEM AND METHOD FOR ASCERTAINING FIELD POSITION

BACKGROUND AND SUMMARY

The present invention relates generally to systems and methods for ascertaining field position and specifically to position on the type of field used in American football (i.e. 100 yards in length, numbered from each end zone in one yard increments, in ascending order to a common 50 yard line).

The persons charged with providing play by play annunciation and commentary (announcers, commentators, etc.) must have accurate information about the yards gained or lost on a given play relative to the line of scrimmage. Additionally, this information must be ascertained and reported quickly and accurately, in real time. This problem is exacerbated by the fact that the time span between some plays (e.g. a "hurry up" scenario) can be as few as 5 to 10 seconds.

Conventionally, the announcer must locate the yard markers (maintained by field personnel) and perform a mental calculation of yards lost or gained for each play. This becomes especially difficult when the ball traverses the 50 yard line.

The present invention overcomes these problems, as well as provides other objects and advantages that will be apparent to those of skill in the art, by providing a system of first and second wheels, movable with respect to each other, that are marked in such a way as to allow the speedy calculation of yards gained or lost relative to the line of scrimmage.

A first wheel is divided into 120 increments (each marked with a notch) equally placed around the entire periphery of the wheel. The increments are marked in ascending order from 1 to 99, then in descending order from −20 to −1. The 0 position is marked with an arrow originating from the center of the wheel. It is labeled as the line of scrimmage (LOS) marker.

A large indicia is provided every fifth number (i.e. 5, 10, 15, . . . 95, −20, −15, . . . −5). Smaller indicia are provided at increments of one between the large indicia. Two opposing arrows marked "yards gained" (clockwise oriented), and "yards lost" (counterclockwise oriented) point away from the line of scrimmage arrow.

A second wheel is marked with 120 increments (each marked with a notch) that correspond in size and location to the notches of the first wheel. The second wheel is marked starting at zero yards (marked as "goal" to indicate the goal line) in ascending order, in increments of 1, to a common 50, then in descending order from 49 to the goal line. There are 19 unmarked increments on the second wheel.

In operation, the first wheel is turned so that the LOS marker aligns with the indicia on the second wheel to correspond to the line of scrimmage (current ball position) as marked by the field personnel. After the subsequent play ends, the field personnel move the line of scrimmage to correspond to the new field position. At this point, the new field position is found on the second wheel. Then, the corresponding indicia on the first wheel is noted. This number reflects how many yards were gained (or lost). This number is reported and the first wheel is again rotated so that the LOS marker corresponds to the new ball position and the process is repeated. Thus, the yards gained or lost can be accurately and speedily reported without having to perform a mental calculation. This procedure can be equally well applied to interceptions, fumbles, punts, and kickoffs.

DETAILED DESCRIPTION

A system for ascertaining field position comprises, first and second wheels 110, 120. Each of the wheels are substantially planar and round, and have inner and outer surfaces. First wheel 110 has a relatively smaller diameter than second wheel 120.

First wheel 110 is rotatably attached to second wheel 120 at the center such that the outer surface of the second wheel is adjacent to the inner surface of the first wheel and the two wheels are coaxial. This can be accomplished various ways (e.g. rivets). Both wheels are marked on the outer surface thereof.

Figure 2:
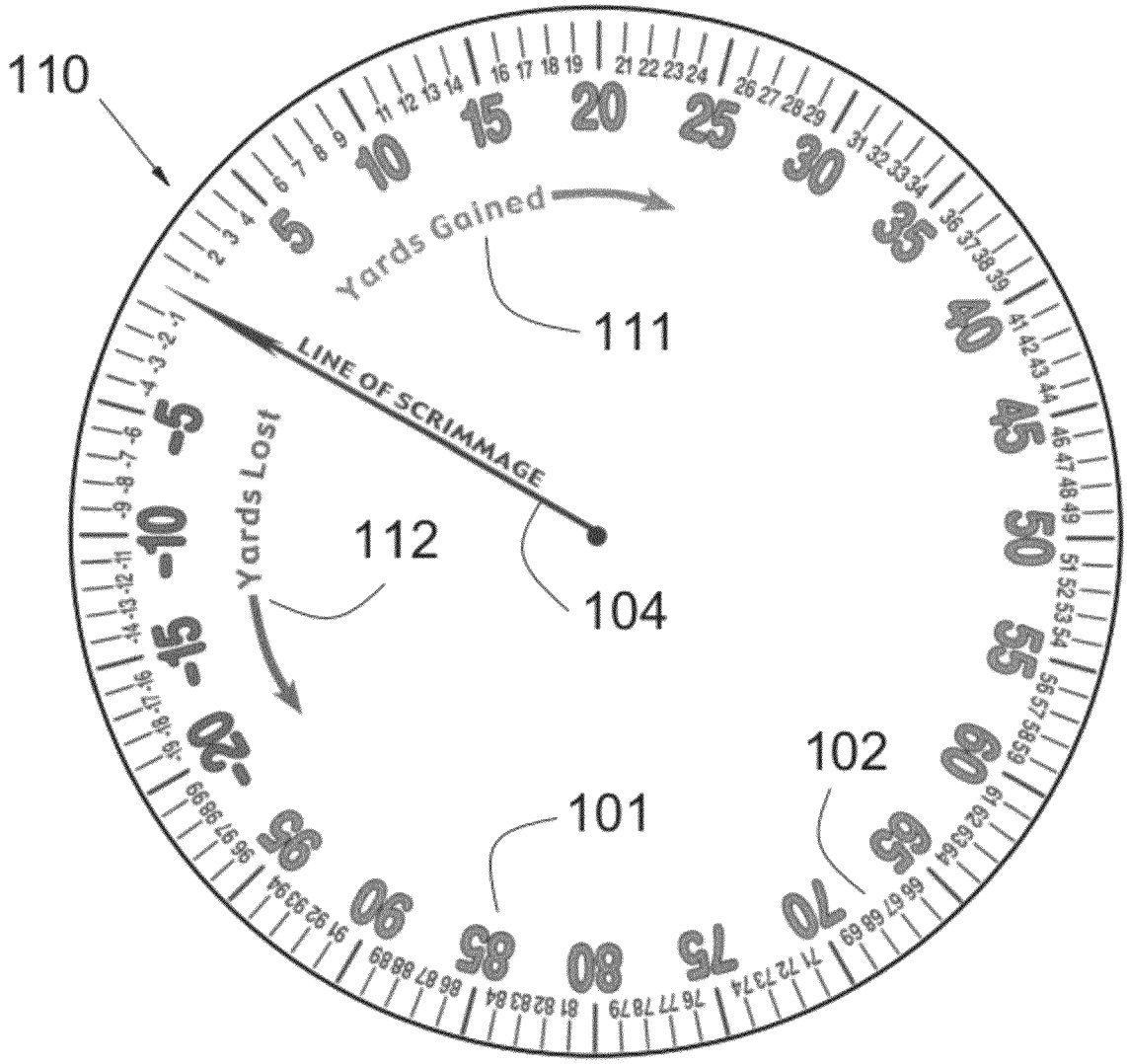
FIG. 2 depicts a plan view of first wheel 110.

As depicted in FIG. 2, first wheel 110 is marked with 120 notches equally spaced around the outer periphery. First arrow 104 originates from the middle of first wheel 110 and terminates near the outer periphery. The arrow portion replaces the first notch. The arrow is labeled "LINE OF SCRIMMAGE". Each of the remaining notches are numbered (indicia 102) in increments of 1, beginning with 1 up to 99, then in descending order from −20 to −1. Every fifth number (i.e. 5, 10, 15, etc.) is labeled with enlarged font (indicia 101) and radially offset inwardly from the other numbers. Second and third arrows 111, 112, are oriented clockwise and counter clockwise, respectively. They are marked with "yards gained" and "yards lost", respectively, and are intended to indicate which direction to move first wheel 110 relative to second wheel 120 according to the described operation.

Figure 1:
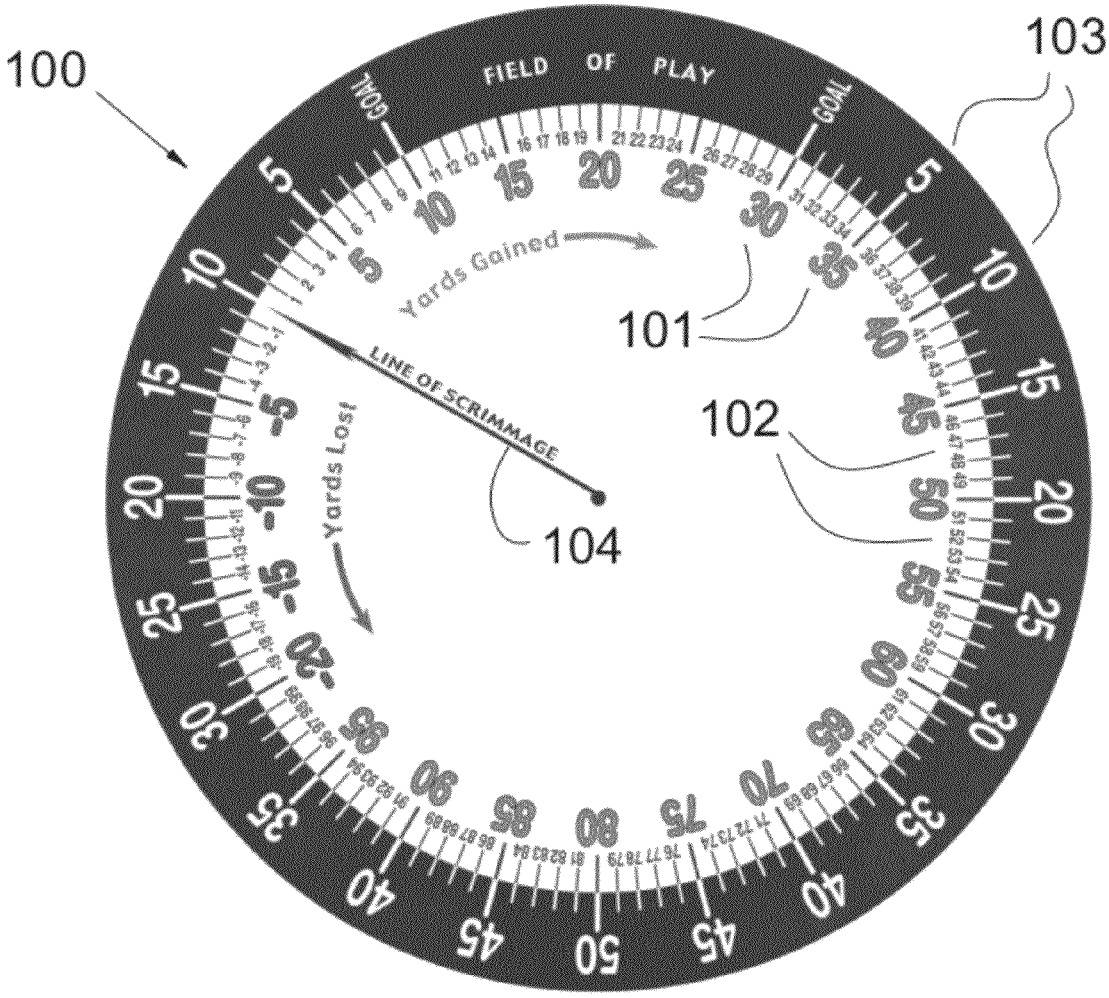
FIG. 1 depicts a plan view of wheel assembly 100.
Figure 3:
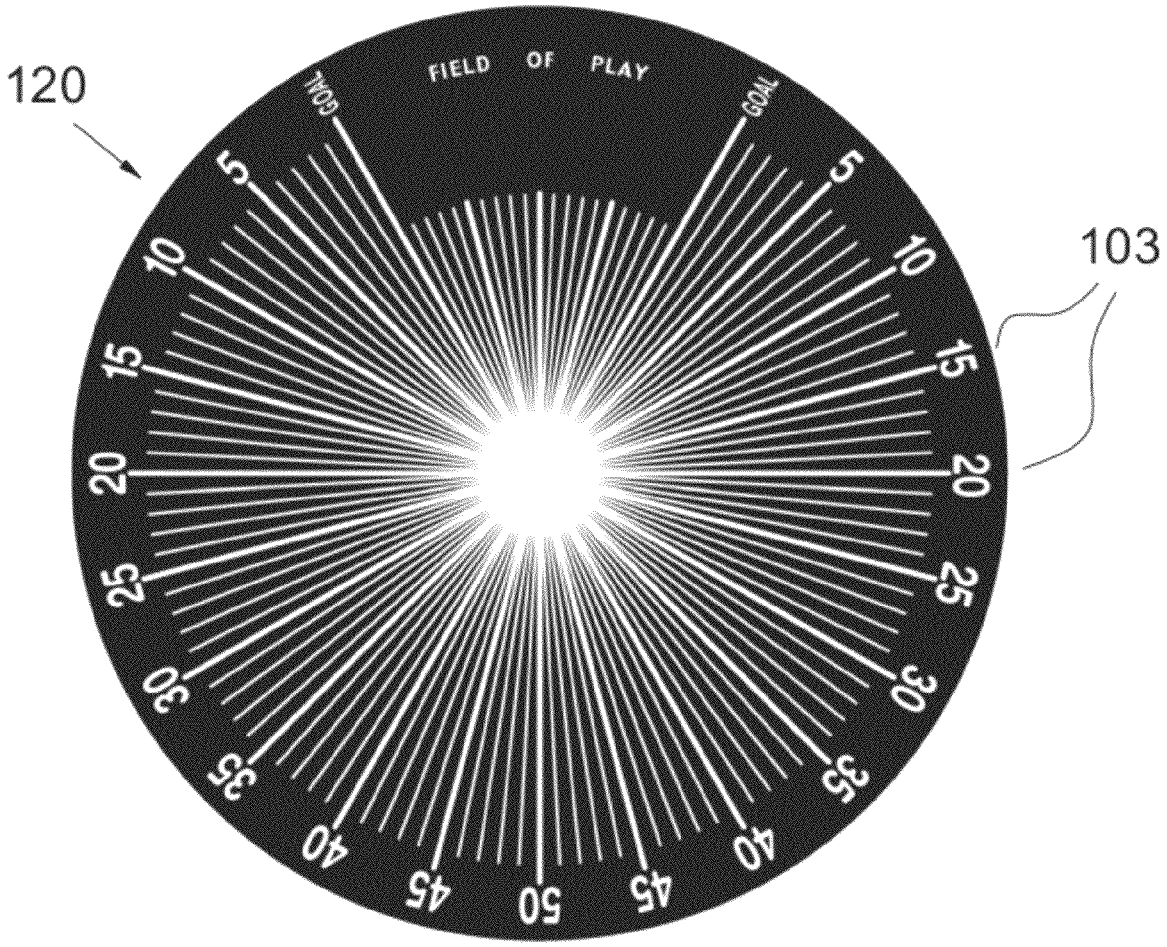
FIG. 3 depicts a plan view of second wheel 120.

As depicted in FIG. 3, second wheel 120 is marked with 120 notches equally spaced around the second wheel and each originating from the center of the second wheel and terminating near the outer periphery. As depicted in FIG. 1, a substantial portion of second wheel 120 is obscured by first wheel 110. Thus, the notches of second wheel 120 are not entirely visible. It should thus be apparent that the notches do not have to extend all the way to the center of the wheel because they are not viewable.

Returning to FIG. 3, 101 notches extend relatively further towards the periphery of second wheel 120. The remaining 19 are truncated and thus not viewable when the wheels are assembled (100, FIG. 1). The 101 consecutive notches are marked starting with "goal" (replaces the numeral 1) then a numerical indicator (103) every fifth notch from 5 to 50, (i.e. 5, 10, 15, . . . 50) then in descending order from 45 to 5 to correspond with the markings of a football field. The one hundred and first notch is marked as "goal" (replaces the numeral 1).

Generally, the wheels are sized such that they can be easily manipulated while in front of a user. A preferable, but not essential, size comprises second (outer) and first (inner) wheels 120, 110 having diameters of approximately 8.5 and 7.5 inches, respectively.

The wheels are preferably made of a semi rigid material (e.g. thin cardboard) to withstand moderate wear and tear. Alternatively, they can be made of thin, flexible plastic or vinyl which has the added advantage of being moisture resistant.

The markings and background colors of the wheels are preferably colored to facilitate quick and easy discernment of the various numbers and other markings relative to each other. Although black and white schemes can be used, other colors, such as green and red can be used to mark either numbers, notches or arrows.

In one embodiment, second wheel 120 has a black background with white indicia and first wheel 110 has a white background with black notches and arrows, and green numbers.

What is claimed is:

1. A system for ascertaining field position comprising:

first and second wheels, each being substantially planar and round, each having inner and outer surfaces;

the first wheel having a relatively smaller diameter and being rotatably attached to the second wheel such that the outer surface of the second wheel is adjacent to the inner surface of the first wheel;

wherein the first wheel being marked on the outer surface thereof, and further being marked with 120 notches equally spaced around the outer periphery thereof, the first notch comprising a first arrow originating from the middle of the first wheel, the arrow being identified as the line of scrimmage, each of the remaining notches being numbered in increments of 1, beginning with 1 up to 99, then in descending order from −20 to −1, every fifth number being in a relatively enlarged font and radially offset inwardly from the other numbers, being marked with a second, clockwise oriented, arrow originating from the first arrow and being marked as "yards gained", being marked with a third, counter clockwise oriented, arrow originating from the first arrow and being marked as "yards lost";

wherein the second wheel being marked on the outer surface thereof, and further being marked with 120 notches being equally spaced around the second wheel and each originating from the center of the second wheel and terminating near the outer periphery thereof such that a portion of 101 consecutive notches are viewable, the 101 consecutive notches being marked starting with "goal" then a numerical indicator every fifth notch from 5 to 50, then in descending order from 45 to 5, the one hundred and first notch being marked as "goal".

* * * * *